US008167697B2

(12) United States Patent
Jackson

(10) Patent No.: US 8,167,697 B2
(45) Date of Patent: May 1, 2012

(54) RUMMY-TYPE GAME FOR ELECTRONIC CASINO GAMING

(75) Inventor: Kathleen Nylund Jackson, Scituate, MA (US)

(73) Assignee: Precedent Gaming, Inc., Scituate, MA (US)

( * ) Notice: Subject to any disclaimer, the term of this patent is extended or adjusted under 35 U.S.C. 154(b) by 562 days.

(21) Appl. No.: 12/319,548

(22) Filed: Jan. 8, 2009

(65) Prior Publication Data

US 2009/0181742 A1 Jul. 16, 2009

Related U.S. Application Data

(60) Provisional application No. 61/010,441, filed on Jan. 9, 2008.

(51) Int. Cl.
*A63F 9/24* (2006.01)

(52) U.S. Cl. ..... 463/13

(58) Field of Classification Search ..... None
See application file for complete search history.

(56) References Cited

U.S. PATENT DOCUMENTS

| | | | | |
|---|---|---|---|---|
| 5,288,081 | A | 2/1994 | Breeding | 273/292 |
| 5,374,067 | A | 12/1994 | Jones | 273/292 |
| 5,380,012 | A | 1/1995 | Jones et al. | 273/292 |
| 5,437,462 | A | 8/1995 | Breeding | 273/292 |
| 5,544,892 | A | 8/1996 | Breeding | 273/292 |
| 5,601,488 | A | 2/1997 | Kadlic | 463/13 |
| 5,816,576 | A | 10/1998 | Aramapakul et al. | 273/292 |
| 5,853,325 | A | 12/1998 | Kadlic | 463/13 |
| 6,019,374 | A | 2/2000 | Breeding | 273/292 |
| 6,273,424 | B1 | 8/2001 | Breeding | 273/292 |
| 6,334,614 | B1 | 1/2002 | Breeding | 273/292 |
| 6,443,456 | B1 | 9/2002 | Gajor | 273/303 |
| 6,454,266 | B1 | 9/2002 | Breeding | 273/292 |
| 6,481,717 | B1 | 11/2002 | Richardelle | 273/292 |
| 6,533,279 | B2 | 3/2003 | Moody et al. | 273/292 |
| 6,685,189 | B2 | 2/2004 | Cherven | 273/304 |
| 6,698,759 | B2 | 3/2004 | Webb et al. | 273/292 |
| 6,705,943 | B2 | 3/2004 | Awada | 463/13 |
| 6,708,975 | B1 | 3/2004 | Fox et al. | 273/292 |
| 6,905,122 | B2 | 6/2005 | Weigl et al. | 273/292 |
| 7,175,522 | B2 * | 2/2007 | Hartl | 463/11 |
| 7,246,799 | B2 | 7/2007 | Snow | 273/292 |

(Continued)

OTHER PUBLICATIONS

U.S. Appl. No. 11/653,746, filed Jan. 16, 2007, Jackson.

*Primary Examiner* — David Graybill

(57) ABSTRACT

A method of playing a wagering rummy-type card game on an electronic device wherein the object of the game is to create sets or melds of cards that each comprise exactly a straight, flush, straight flush, royal flush, and/or like ranks. The game begins with a total wager from each player, the total comprising at least one separate wager, and is played with a predetermined number of initially-dealt cards to each player. The initially-dealt cards are placed into and completely fill at least two melds. Preferably the cards are automatically placed into the melds by an Optimum Expected Value function. Each player then has the option of folding, or alternately forfeiting one wager or placing an additional wager to receive each of a predetermined number of community cards that are then sequentially dealt. The player has the option to replace any card in any meld with a community card, and the cards in the melds may be rearranged after any replacement. The game result may be determined before or after the final community card is dealt and/or replaced, with the winning wagers being determined by a predetermined paytable.

18 Claims, 13 Drawing Sheets

U.S. PATENT DOCUMENTS

2003/0008697 A1* 1/2003 Hartl ..... 463/11
2003/0075869 A1 4/2003 Breeding et al. ..... 273/292
2004/0038720 A1 2/2004 Valente ..... 463/11
2005/0090304 A1 4/2005 Crawford, III et al. ..... 463/13
2005/0164759 A1 7/2005 Smith et al. ..... 463/11
2005/0164762 A1 7/2005 Smith et al. ..... 463/16
2006/0055114 A1 3/2006 White et al. ..... 273/309
2006/0058083 A1 3/2006 Crawford, III et al. ..... 463/11
2006/0058085 A1 3/2006 White et al. ..... 463/11
2006/0058088 A1 3/2006 Crawford, III et al. ..... 463/13
2006/0058090 A1 3/2006 Crawford, III et al. ..... 463/13
2006/0058091 A1 3/2006 Crawford, III et al. ..... 463/13
2006/0058092 A1 3/2006 Crawford, III et al. ..... 463/13
2006/0058093 A1 3/2006 White et al. ..... 463/13
2006/0066051 A1 3/2006 Nicely ..... 273/292
2006/0068498 A1 3/2006 White et al. ..... 436/17
2006/0068864 A1 3/2006 White et al. ..... 463/13
2006/0068865 A1 3/2006 White et al. ..... 463/13
2006/0068866 A1 3/2006 White et al. ..... 463/13
2006/0068867 A1 3/2006 White et al. ..... 463/13
2006/0068868 A1 3/2006 Crawford, III et al. ..... 463/13
2006/0068869 A1 3/2006 White et al. ..... 463/13
2006/0068870 A1 3/2006 Crawford, III et al. ..... 463/13
2006/0068871 A1 3/2006 Crawford, III et al. ..... 463/13
2006/0068879 A1 3/2006 Crawford, III et al. ..... 463/17
2006/0068899 A1 3/2006 White et al. ..... 463/25
2006/0151952 A1 7/2006 Encinas ..... 273/292
2006/0199629 A1 9/2006 Sines et al. ..... 463/12
2006/0205472 A1 9/2006 Sines et al. ..... 463/16
2006/0246976 A1 11/2006 Sines ..... 463/13
2007/0015561 A1 1/2007 Sines et al. ..... 463/12
2007/0049368 A1 3/2007 Kuhn et al. ..... 463/12
2007/0049369 A1 3/2007 Kuhn et al. ..... 463/12
2007/0072663 A1 3/2007 Kuhn et al. ..... 463/11
2007/0072664 A1 3/2007 Kuhn et al. ..... 463/11
2007/0142107 A1 6/2007 Kuhn et al. ..... 463/16
2007/0281786 A1 12/2007 Sines et al. ..... 463/31
2008/0171587 A1* 7/2008 Jackson ..... 463/20
2008/0237985 A1* 10/2008 Cogert et al. ..... 273/292

* cited by examiner

RUMMY-TYPE GAME FOR ELECTRONIC CASINO GAMING

RELATED APPLICATION DATA

This Application claims priority from U.S. Provisional Patent Application No. 61/010,441, filed Jan. 9, 2008, and having the Title RUMMY-TYPE GAME FOR ELECTRONIC CASINO GAMING.

BACKGROUND OF THE INVENTION

1. Field of the Invention

The present invention relates to a rummy-type card game suitable for use in casinos and other gaming establishments as an electronic table game or a video poker game. The invention further relates to electronic casino gaming wherein the object of the game is to create melds (orders of cards, runs or repetitions of ranks) that may provide wins.

2. Background of the Art

Games based upon variations of poker have attained enormous popularity as casino-type entertainment games, particularly in the last twenty years. The success of poker games in the gaming industry is partially based on the game's simplicity (i.e., there is widespread public knowledge of the game rules) and the fact that players feel more directly involved in exercising judgment in the play of the game.

Many new approaches to poker have been developed for casino table games that can be played on a blackjack-like table, in which the players compete against the house or against a paytable, and in which the house has an edge or percentage advantage. These poker variations now rival the popularity of blackjack in many venues. Specific variants include Let It Ride® poker, Caribbean Stud Poker® game, Three Card Poker® game, Four Card Poker™ game and 3-5-7 Poker™ game. Each of these games is poker-based; i.e., decisions are based on a knowledge of traditional poker rules and basic standard poker rankings. This makes these games appealing to many players who fully understand the intricacies of poker's gameplay decisions, ranks, probabilities and payout possibilities. The aforementioned games are most often played on a traditional felt table, with a live human dealer dealing the cards, and resolving the wagers. This is easily accomplished due to the simplicity of each game, the relatively few amount of cards in each hand, the straightforwardness of any decision-making, and the lack of complexity in resolving the wagers.

It has been problematic to create a more complicated casino game for a table, since dealing a larger number of cards or permitting multiple decisions on the player's part slow the game and therefore lessen the house take. The house has a built-in edge on virtually any gambling game, so reducing the number of hands played in a particular time period decreases the revenue for the casino.

Manufacturers of casino products have recently turned their attention to electronic table games. These games rely on a table that has at least individual player monitor screens and a computer processor. As in internet card play, the gameplay is accelerated, providing more decisions per hour, and thus more revenue for the casino. Another appealing aspect of electronic table gaming from the casino's point of view is that a live dealer may not be needed, reducing personnel costs. And even if a dealer is required, he may not need to be professionally trained, as the processor will handle any complex decisions, results or compensations. To date, however, the majority of offered electronic table games are simply electronic versions of traditional felt-top games. Although the number of hands per hour is increased, the gameplay does not take advantage of the possibilities provided by the computer processor. Examples of electronic casino table card play systems include at least Published U.S. Patent Applications Nos. 20050090304; 20060055114; 20060058083; 20060058085; 20060058088; 20060058090; 20060058091; 20060058092; 20060058093; 20060068498; 20060068864; 20060068865; 20060068866; 20060068867; 20060068868; 20060068869; 20060068870; 20060068871; 20060068879; and 20060068899 (PokerTek, Inc. applications); 20050164759; 20050164762; (Shuffle Master, Inc.); and 20060199629; 20060205472; 20070015561; 20070049368; 20070049369; 20070072663; 20070072664; 20070142107; and 20070281786 (Sines et al.).

It would be advantageous to invent a more complex game for electronic table gaming that takes advantage of processing abilities and relies on familiar game patterns, yet provides revolutionary decision-making choices while accelerating the pace of the game.

U.S. Pat. No. 7,246,799 (Snow) discloses a method of playing a wagering card game for a number of players using standard playing cards having a standard rank and involving standard poker hand rankings that comprises: each player placing at least four distinct wagering parts to participate in the game; dealing three cards to each player and at least two common cards, all of the at least two common cards being dealt face down; giving each player the chance to examine the cards received by that player and to withdraw at least a first part of the at least four distinct wagering parts wager based on the rank of the player's cards prior to one of the at least two common cards being dealt face down being exposed; showing the at least one common card, thereby providing at least a partial hand for each player, each player's at least a partial hand comprising the shown at least one common card and the cards each player was dealt; allowing each player to withdraw a second part of the at least four wagering parts and forfeiting a third part of the at least four wagering parts; showing at least one more common card to expose all common cards that had been dealt face down; and resolving each player's remaining wager based on the rank of that player's hand, which remaining wager was not withdrawn.

U.S. Pat. No. 6,708,975 (Fox, et al.) describes a card game that is preferably played on an electronic video gaming machine in which a single player plays against a pay table. The player makes a wager for each of two or more hands that the player wishes to play. The player selects a poker hand format for each hand, with no two hands having the same poker hand format. After the player has made his wagers and selected the poker hand format for each hand, the computer controls deal out face up each initial five card hand of poker in each poker format selected by the player. The player selects none, one or more of the face up cards from each hand as cards to be held. The non-selected cards are discarded from each first hand and replacement cards are dealt face for each discarded card. The poker hand ranking of the resulting final five cards of each hand are then determined. The player is then paid a preestablished amount based on the amount of each wager if the resulting cards of each hand comprise a predetermined poker hand ranking.

U.S. Pat. No. 6,705,943 (Awada) teaches an invention in which, in one of three table games and in one of two games played on a gaming machine, three card Stud Poker, five card Stud Poker and seven card Stud Poker are combined. In a second table game, five card Stud Poker and Seven Card Stud Poker are combined. In a third table game three card Stud Poker and seven card Stud Poker are combined. In a second game played on the gaming machine, five card Draw Poker and seven card Stud Poker are combined.

U.S. Pat. No. 6,698,759 (Webb, et al.) discloses a casino wagering game that comprises 1) placing a wager to participate in the game; 2) a dealer dealing a hand of three cards to each player who placed a wager; 3) resolving the player hands against a plurality of predetermined winning poker outcomes; and 4) paying each player odds whose hand consists of a predetermined winning outcome. The present invention comprises a casino style wagering game against a dealer, comprising the steps of placing a wager, dealing a three card poker hand to each player, dealing at least three cards to the dealer, and paying the player on the bet when a poker rank of his hand exceeds the rank of a dealer's hand. In a preferred form of the invention, the hierarchy of poker hand ranking differs from that of standard five card poker.

U.S. Pat. No. 6,533,279 (Moody, et al.) teaches gameplay in which an initial hand of three cards is dealt to the player and three community cards are dealt face down. The player decides which cards to hold and which cards to discard. For each card that is discarded, the player uses one of the community cards as the replacement card. If the player discards one card, Card #1 is used as the replacement card. If the player discards two cards, Card #1 and Card #2 are used as the replacement cards. If the player discards all three cards, Card #1, Card #2 and Card #3 are used as the replacement cards. After the player has made his decision, all of the community cards are turned face up and the outcome of the player's final three card hand is determined. Winning and losing outcomes are determined based on a pay table and the amount of the player's wager.

U.S. Pat. No. 6,481,717 (Richardelle) discloses a method of playing a card game that is made up of steps dealing a first hand consisting of a first predetermined number of cards, requiring one or more players to each elect whether or not to play a second hand, comparing each of the first hands to determine whether or not they constitute a winning hand, dealing a second hand consisting of a second predetermined number of cards and including the first hand, comparing each of the second hands using a predetermined ranking as a criterion for comparison to determine a winning hand, and designating as a winner each player who had a winning first hand and/or a winning second hand. The first predetermined number of cards consists of two cards, and the first hand is played as a Blackjack hand. The second predetermined number of cards consists of a number of cards, in addition to the cards drawn by each player for the Blackjack hand, to make up a poker hand. Each player is required to place a bet before each step of dealing the first and second hands, and they are paid after the step of designating winning players. Such step of paying the winning player(s) includes the step of paying the winning player according to the odds set forth in a predetermined table depending upon the poker rank of the winning hand(s).

U.S. Pat. No. 6,443,456 (Gajor) describes a method that involves card games in which the player plays multiple hands of cards during one play session. The cards are dealt out in horizontal fashion and may include three card, five card, seven card or higher card games. The player may wager on each horizontal row of cards dealt separately and each row of cards will be played as a separate poker game. The player may also make a separate wager (Parlay Wager) that will payoff if multiple winning hands are obtained in one play session. Additional versions of the game also provide for additional wagering. For example in a three card three hand game, the horizontal dealing of the cards are such that each row of cards are situated in sequential order so that first hand is directly over the second hand and the second hand is directly over the third so that a three card by three card matrix is created. In addition to having the ability to wager and win the three hands drawn in horizontal fashion and the parlay wager for multiple winning hands, the player also has the ability to win five additional ways (i.e., three vertical paylines and two diagonal combinations paylines).

U.S. Pat. No. 5,380,012 (Jones, et al.) discloses a card game variant that enables players to compete in the familiar format of a rummy-type game against other players in a live cardroom format. In a preferred seven-card embodiment, players initially ante, then receive two cards face down and one card face up from a non-playing dealer. Players electing to continue play after a forced bet or fold option each receive additional cards, one at a time with each card followed by a betting round, to complete a seven card hand consisting of three face down cards and four face up cards. The point count totals of the hands of each remaining player are then determined and compared, with each Ace counting 1, each deuce counting 2, etc., and with tens and face cards each counting 10. Each spread consisting of three or more suited cards in sequence or three or four of a kind counts zero (0). The object of the game is to have the lowest point count total, and the winning player(s) are awarded the accumulated wagers or pot.

U.S. Pat. No. 5,374,067 (Jones) discloses a card game variant that enables players to compete in the familiar format of a rummy-type game against the house. In a preferred five-card embodiment, players initially ante, then receive four cards face down from the dealer, while the dealer received three cards face down and one card face up. Players electing to continue play after a bet or fold option and the dealer each receive one more card face down to complete a five card hand. The point count total of the hand of each remaining player and the dealer are then determined and compared, with each Ace counting 1, each deuce counting 2, etc., and with tens and face cards each counting 10. Each spread consisting of three or more suited cards in sequence or three or four of a kind counts zero (0). The object of the game is to have a lower point count total than the dealer. The dealer only plays when his hand totals 32 or lower. Any player possessing a hand having a point count total less than that of the dealer's hand wins and receives a payout, with hands having some predetermined point totals receiving a bonus amount designated in a payout table. If the dealer's hand totals more than 32, then each player is paid 1 to 1 on his ante and all other bets are cancelled. The game may be played in both live table and electronic video poker formats.

United States Patent Application No. 20060246976 (Sines) describes methods of playing a wagering game of chance, including defining a payout schedule, dealing an initial hand to at least one player, and accepting a final bet from the at least one player so as to define at least one final betting player. Other method steps include dealing one or more community cards, wherein at least one of the community card is selectively combined with at least one card within each initial hand such that a final hand is defined for each final betting player, and awarding a payout to each final betting player holding a final hand that so qualifies in accordance with the payout schedule. Other embodiments provide for respective gaming tables and individual gaming machines including respectively electronic controllers, each controller configured to execute one or more method steps in accordance with the present embodiments provided for herein.

United States Patent Application No. 20060151952 (Encinas) teaches a wagering game for casinos consisting of 1) participation by placing a wager; 2) a table games dealer who delivers multiple cards to all wagering players; 3) the table games dealer delivering three community cards; 4) resolution of all cards played based upon predetermined combinations of cards; 5) paying all wagers odds based upon a predetermined set of winning combinations. The current invention consists of a casino type wagering game to achieve payable combinations of cards, comprising the steps of placing a wager, dealing a multiple card hand to each player, dealing three community cards, having each player choose one community card to construct a complete poker hand, and paying any player who achieves a predetermined winning combination of said hand.

United States Patent Application No. 20060066051 (Nicely) discloses a card game and method of playing the card game. The card game involves placing cards into pre-defined card positions in the form of grids or matrices. For example, a 3.times.3 grid is filled with nine cards. Game outcome combinations are defined by three horizontal, three vertical and two diagonal pay lines. Another grid arrangement includes a 3.times.3 grid with each row and column having an extra card position at each end thereof. Accordingly, after the 3.times.3 grid is filled with random cards, a player may select one or more pay lines after which the two extra card positions are filled. The player is paid for any winning hands formed of the five card defined by the selected pay lines. Countless grid arrangements and pay lines are conceivable. In other versions, the player may replace one or more initially dealt, displayed or otherwise provided cards. The card game and method disclosed herein may be played through an electronic gaming device, over the Internet or at a live gaming table with a dealer.

United States Patent Application No. 20040038720 (Valente) describes a method for playing a card game by a plurality of players. The game is a variation of Gin Rummy and has two pots including wagers by the players. The method includes the steps of pairing the players; providing a deck of cards to each pairing; establishing a target numerical value for completion of the card game and having each of the players of a pairing place a first wager on results of a play of a hand of the card game in a first pot and all of the players place a second wager on results of a complete play of the card game in a second pot. Play begins when a cards are dealt to each player in a pairing in a face down manner, one card is placed in a face up manner and the remaining undealt cards are placed in a face down manner. A first player draws one card from either a top card of the remaining undealt cards or the face up card. The first player then discards a card and, if possible, signals an end of a hand of play. End of play of a hand is followed by each player of the pairing displaying their playing cards; determining a difference in unmatched cards held by each player; tallying a score for the signaling player, in accordance with predetermined rules; and paying the signaling player the first pot. The game ends when at least one of the players achieves a score that is greater than the target numeric value and the player is paid the second pot.

Published U.S. Patent Application No. 20030075869 and U.S. Pat. Nos. 5,288,081; 5,437,462; 5,544,892; 6,019,374; 6,273,424; 6,334,614; and 6,454,266 (Breeding) discloses a game in which and initial multipart wager is placed and a limited number of the parts of the wager may be withdrawn during play of the game, while the game continues to be played.

Each of the references discussed in this text art are incorporated herein in their entirety for all purposes including enablement of multiplayer platforms and structures for execution of games according to the present invention.

It is an ever-increasing challenge to provide electronic card game players with new and enticing gameplay features that will stimulate player interest and increase time at the table or the machine.

SUMMARY OF THE INVENTION

A method of playing an electronic wagering card game for a single player or multiple players uses a single deck of 52 standard playing cards having a standard rank or 52 cards with one or more jokers, wild cards or specialty cards (e.g., bonus indicators, special feature indicators, additional card(s) indicator, etc.). The card game is generally based on the traditional gameplay of rummy wherein the object of the game is to create qualifying sets, combinations, orders, multiples or melds of cards that are each comprised of exactly a straight, flush, straight flush, royal flush, pairs, three-of-a-kind, four-of-a-kind and/or like designated combinations or ranks, these predetermined types of groupings of cards will be collectively referred to as "melds" in the description of the present technology and inventions. The game begins with a total (e.g., multiple part) wager from each player, the total wager comprising at least an Ante wager and at least one separate wager, or alternately an Ante wager that is larger than any other wager required in the play of the game. The game is played with a predetermined number of initially-dealt cards to each player. The initially-dealt cards are placed into and completely fill at least two separate regions wherein an aspect or objective of the game is to form melds, hereinafter referred to as "meld areas." Preferably the cards are automatically placed into the melds by an Optimum Expected Value function programmed into a computer and executed by the processor of the computer. Execution is preferably by a standard-PC or MAC processor, but it is possible to provide hardwired chips, boards, ASICs or field programmable gated arrays (FPGSa). The Optimum Expected Value function allows the optimum placement of the initially-dealt cards into specific meld areas based on predetermined highest mathematical probability that the cards in each meld, individually and collectively will eventually (statistically), after additional cards become or may become available for replacement into a particular meld, result in at least a qualifying straight, flush, straight flush, royal flush, and/or like ranks. Each player then has the option of forfeiting one wager by paying it to the machine or, alternately, placing at least one additional wager, to receive each of a predetermined number of community cards that are then sequentially dealt. The at least one additional wager may be a series of wagers that have to be placed each time that an additional card is requested or enabled (e.g., as a community card) in the play of the game). At any time the player chooses not to receive a community card, he may choose to Fold and exit the game (preferably at least the Ante wager being forfeited and paid to the machine), or Take Win and exit the game (if the meld card arrays qualify as winning arrays). The player has the option to replace any card in any meld area with a community card (the community card being available to each and all players at the electronic gaming table or in the community game), and the cards in the meld areas may be rearranged after any replacement. The game result may be determined before or after the final community card is dealt and/or replaced, and is based on a totality of resultant qualifying melds in each, some or all meld areas, with the winning wagers being determined by a predetermined paytable.

DETAILED DESCRIPTION OF THE INVENTION

Figure 1:
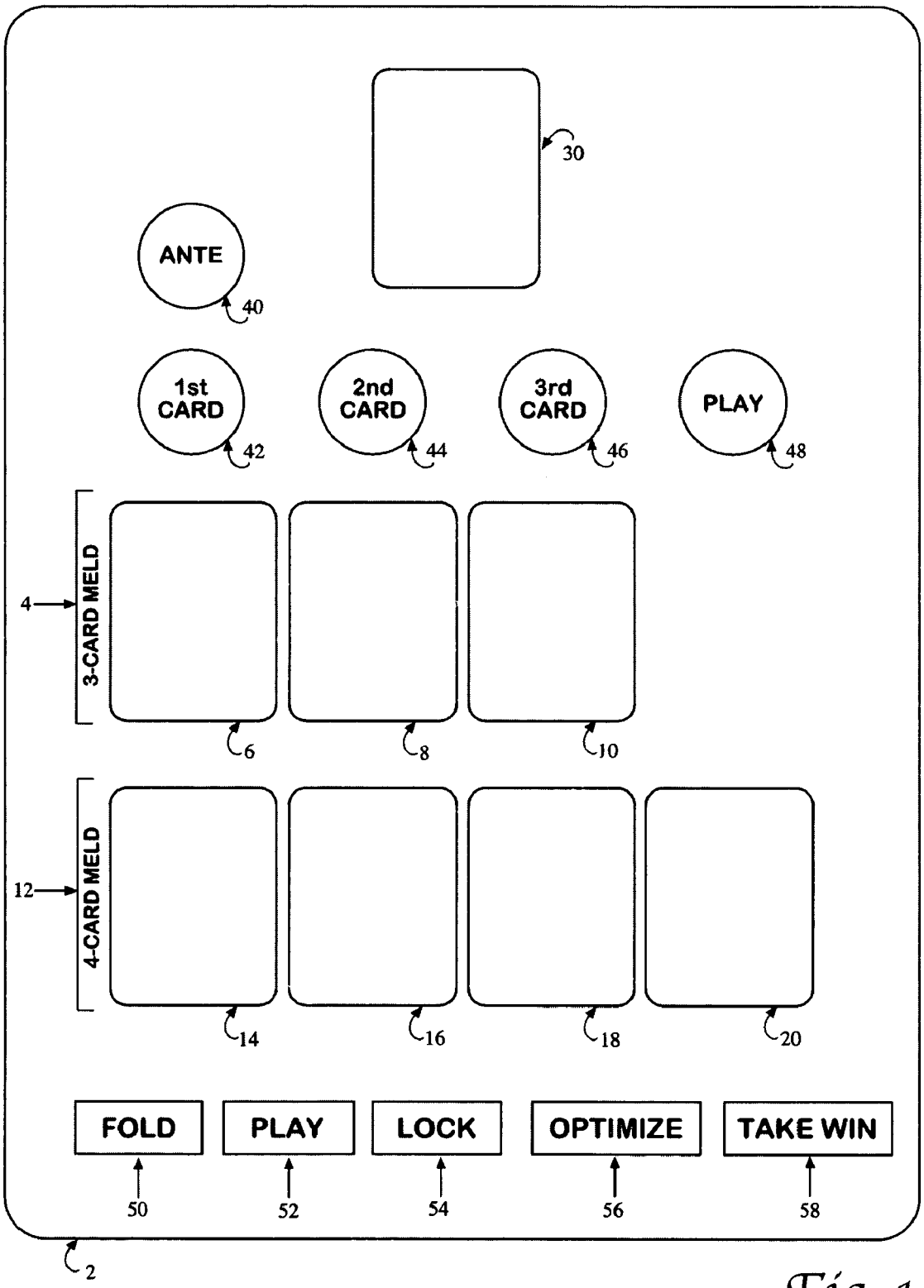
FIG. 1 shows a screen monitor with the elements of the game technology described herein.

A method of playing an electronic wagering card game for a single player or multiple players using player exclusive cards or community cards to complete hands. The game preferably uses as the source of symbols one original deck of 52 standard playing cards having a standard rank system, although wild cards, jokers and specialty cards may be used, and although optionally, multiple decks each of 52 cards may be used. Alternately, a deck or decks, each of more than 52 cards that may include jokers, wild cards or special cards may be used. The method may be played utilizing gameplay and strategies as are familiarly known in rummy-type games. As disclosed in "According to Hoyle" (copyright 1956, 1965, 1970; publisher: Ballantine Books, pages 71-72), the object of a rummy game is to form the hand into sets. A set may be of either of two types: a group of three or four cards of the same rank, or a sequence of three or four cards of the same suit. A meld consists of either a set or a set that has been presented for final play and is a predetermined allowed combination of cards. In the use of electronic systems, additional sets, beyond those standard in conventional rummy-type games may be used. For example, "kangaroo straights" such as Ace-3-5, 2-4-6, 10-Q-Ace, etc. may be used, where there is exactly two ranks different between each of three cards, which may be also requires to be same-suited. Any game based on draw-and-discard and making melds is some sort of rummy game by definition, especially when the melds are not compared with other melds or a paytable according to poker rankings. The present invention relies on a draw-and-discard gameplay and utilizes sets, melds, groups and/or sequences, including sequences of at least or exactly three or four cards of advancing rank.

The game may begin with each player placing a total wager, the total wager comprising at least an Ante and preferably at least one separate and additional wager. Alternately, a single Ante wager only may be required, the Ante bet being larger than any other wager required in the play of the game. Since the final math has not been as yet analyzed, the present invention may comprise separate wagers including, but not requiring, an Ante Bet, Additional Card Bets, Bonus or Jackpot wagers, and/or Play Bets. The game is played with a predetermined number of random initially-dealt cards to each player. This initially-dealt card array is placed into and must completely fill at least two meld areas, i.e., no meld will contain a blank card area. For example, if seven cards are initially dealt, the cards must be dealt into one 3-card meld attempt and one 4-card meld attempt, or alternately one 2-card meld attempt and one 5-card meld attempt may be used. Alternately, for example, if ten cards are dealt, the cards must be dealt into two 3-card meld attempts and one 4-card meld attempt. Preferably the cards are automatically placed and arranged into the meld areas by an Optimum Expected Value function, as described in and that takes reference from copending U.S. patent application Ser. No. 11/653,746 (Jackson), which is incorporated herein by reference. In addition, an indicator window may allow the player to view the minimum number of community cards that are needed to possibly create a winning result or to display a percentage value indicating a probability of a winning event(s) occurring from the original cards. After the initial array of cards has been dealt into the meld areas, each player has the option of either folding (preferably losing the Ante wager and/or withdrawing the at least one separate wager, possibly including or not the bonus wager, and withdrawing from the game), or forfeiting one of the at least one separate wagers (or alternately placing an additional wager) to receive a random first community card and remain in the game. This first community card is defined as one card from the depleted deck(s) or original sets of cards comprising the original deck(s) minus the total number of initially-dealt cards. The player(s) may each then have the choice to keep the community card, replacing one of his initially-dealt cards with the community card, which would be effected by appropriate contact on a touchscreen display or by appropriate button pressing. For example, the screens and buttons may be able to highlight one original card in a player's hand for replacement, which may be itself sufficient to replace that card when there is a single community card available for use in replacement. Alternatively, the player may have to press a replace button or replace region on the screen to confirm the replacement of a highlighted or selected card. This latter would tend to avoid accidental replacement of cards. After the said choice is made, the meld cards may again be optimally arranged or "optimized" within single meld areas (as one rule of play) or among the two or more meld areas; preferably, a mechanical or virtual button allows the player to request the optimization, although the optimization may be an automatic step. The indicator window may now allow the player to view a newly calculated minimum number of community cards needed for a possible win and the probability of any successful outcome or all successful outcomes expressed as a percentage. A second community card from the now more-depleted deck may now be offered to all players in the game. The player will then again has the option of either Folding (forfeiting at least the Ante wager), or forfeiting an additional wager (or alternately placing an additional wager) to receive this second community card. According to the rules of the game, a maximum number of community cards are offered in the play of the game, ranging preferably from 1 to 5 community cards, offered one, two or a maximum of three cards at a time, although variation in this play is allowed. It is also possible that when multiple community cards are available at a single time, there may be a limit that less than all community cards can be selected at that single time. Play continues as described above until an end-game situation is reached or a final community card is offered and/or played. At either point, the result of each meld is shown. Each meld must comprise preferably exactly a straight, a flush, a straight flush, a royal flush, predetermined grouping of cards, or like-ranked cards in order to qualify. The final result for each player's game comprises the totality of his game's melds (according to predetermined standards, including options such as highest card in the meld, point totals in the meld, etc.) and a winning result comprises the totality of qualifying melds. Winning results are paid according to a predetermined paytable.

The structure of the wagers may be varied to enable the house to control the house percentage on the game, and the variation of the wager structure may be done in conjunction with varying payout amounts in a paytable. For example, the Ante wager may be a single minimum unit of wager (e.g., at least $1, at least $5, at least $10 or at least $25) and the Play wager or Bet wager may be a defined specific amount or range of amounts (e.g., 1×-2× the Ante, 1×-5× the Ante, exactly 2× the Ante, 2×-10× the Ante, etc.) proportional to the Ante amount. For example, the Play amount may be limited to an amount less than, less than and equal to, equal to, equal to or greater than the Ante, and the proportion of the differences may be fixed. For example, a Play wager less than the Ante may be required to be one-half the Ante wager or larger than or equal to wagers may be restricted to 1-10 times the Ante wager. The allowable size of the Play wager may be restricted based upon the time of the placement of the wager. For example, if a Play wager is or must be placed at the same time as the Ante wager (without viewing the player's cards and with or without an option to fold and withdraw the Play wager), the Play wager may be restricted to less than or less than and equal to the Ante wager or less than, equal to and greater than the Ante wager, within fixed allowable ranges of multiples. If the Play wager is made after the player views the player's cards, then the Play wager may be similarly restricted or limited by ranges and proportions of wagers.

The paytable is constructed so that there is a reasonable statistical advantage to the house in the play of the game. It must be again noted that the paytables are preferably restricted to payment on events where there are predetermined melds in both meld areas. Non-limiting examples of paytables for practice of the present technology are exemplified below.

TABLE 1

| 3-CARD MELD | 4-CARD MELD | PAYOUT ODDS |
|---|---|---|
| Royal Flush | Royal Flush | 50 to 1 |
| Royal Flush | 4-of-a-Kind | 40 to 1 |
| Royal Flush | Straight Flush | 25 to 1 |
| Royal Flush | Straight or Flush | 5 to 1 |
| 3-of-a-Kind | Royal Flush | 40 to 1 |
| 3-of-a-Kind | 4-of-a-Kind | 35 to 1 |
| 3-of-a-Kind | Straight Flush | 15 to 1 |
| 3-of-a-Kind | Straight or Flush | 5 to 1 |
| Straight Flush | Royal Flush | 20 to 1 |
| Straight Flush | 4-of-a-Kind | 15 to 1 |
| Straight Flush | Straight Flush | 10 to 1 |
| Straight Flush | Straight or Flush | 2 to 1 |
| Straight or Flush | Royal Flush | 7 to 1 |
| Straight or Flush | 4-of-a-Kind | 7 to 1 |
| Straight or Flush | Straight Flush | 3 to 1 |
| Straight or Flush | Straight or Flush | 1 to 1 |

TABLE 2

| 3-CARD MELD | 4-CARD MELD | PAYOUT ODDS |
|---|---|---|
| Royal Flush | Royal Flush | 50 to 1 |
| Royal Flush | 4-of-a-Kind | 50 to 1 |
| Royal Flush | Straight Flush | 25 to 1 |
| Royal Flush | Flush | 7 to 1 |
| 3-of-a-Kind | Royal Flush | 40 to 1 |
| 3-of-a-Kind | 4-of-a-Kind | 35 to 1 |
| 3-of-a-Kind | Straight Flush | 15 to 1 |
| 3-of-a-Kind | Flush | 5 to 1 |
| Straight Flush | Royal Flush | 20 to 1 |
| Straight Flush | 4-of-a-Kind | 15 to 1 |
| Straight Flush | Straight Flush | 10 to 1 |
| Straight Flush | Straight or Flush (or only one of these ranks) | 2 to 1 |
| Straight or Flush | Royal Flush | 7 to 1 |
| Straight or Flush | 4-of-a-Kind | 7 to 1 |
| Straight or Flush | Straight Flush | 2 to 1 |
| Straight or Flush | Flush or Straight (different from 3-card hand) | 1 to 1 |

TABLE 3

| 3-CARD MELD | 4-CARD MELD | PAYOUT ODDS |
|---|---|---|
| Royal Flush | Royal Flush | 50 to 1 |
| Royal Flush | 4-of-a-Kind | 50 to 1 |
| Royal Flush | Straight Flush | 25 to 1 (if same suit)<br>15 to 1 (if different suits) |
| Royal Flush | Straight or Flush | 15 to 1 (if same suit)<br>10 to 1 (if different suits) |
| 3-of-a-Kind | Royal Flush | 40 to 1 |
| 3-of-a-Kind | 4-of-a-Kind | 35 to 1 |
| 3-of-a-Kind | Straight Flush | 15 to 1 |
| 3-of-a-Kind | Straight or Flush | 5 to 1 |
| Straight Flush | Royal Flush | 20 to 1 (if same suit)<br>15 to 1 (if different suits) |
| Straight Flush | 4-of-a-Kind | 15 to 1 |
| Straight Flush | Straight Flush | 10 to 1 (if same suit)<br>8 to 1 (if different suits) |
| Straight Flush | Straight or Flush | 2 to 1 |
| Straight or Flush | Royal Flush | 7 to 1 |
| Straight or Flush | 4-of-a-Kind | 7 to 1 |
| Straight or Flush | Straight Flush | 1 to 1 |
| Straight or Flush | Straight or Flush | 1 to 1 |

In a first preferred embodiment of the present invention, a rummy-type game is played on an electronic gaming table. The object of the game is to complete sets of cards or "melds", with each qualifying meld preferably comprising a straight, a flush, a straight flush, a royal flush, predetermined card distributions or like-ranked cards (pairs, three-of-a-kind, and four-of-a-kind). Individual player monitor screens are provided, and preferably a dealer monitor screen is also provided. Alternatively, a common player large screen panel can be provided with individual player areas and community card areas, or a separate screen or monitor provided for the community cards as shown in Published US Patent Applications 20050164759 and 20050164762. Each player monitor screen preferably comprises at least a 3-card meld area, a 4-card meld area, five betting circle areas, a window for indicating the minimum number of community cards need to possibly win, and player input buttons including Fold, Play, Lock, Discard, Replace, Optimize and Take Win. The game preferably is played with one virtual deck of 52 standard playing cards. In one embodiment of a game according to the present technology, where there are three separate offerings of community cards, each player must make five equal bets to begin the game: an Ante wager, a $1^{st}$ community card wager, a $2^{nd}$ community card wager, a $3^{rd}$ community card wager, and a Play wager. Seven different cards are dealt to each player, each card preferably being automatically placed into either the 3-card meld area or the 4-card meld area by an Optimum Expected Value function, although players may be allowed to rearrange cards at their discretion at any time during play. This enables the player to instantly see the most potentially valuable arrangement, clarifying the opportunities for awards and making the game faster. An information window then automatically calculates the minimum number of cards that may be needed to transform the initial array of meld cards into qualifying melds and contemporaneously, separately or alternatively provides a percentage value for success with additional cards available. This percentage display can be constructed to analyze and determine this number based on only a single player's cards and residual cards available (presumed from the single player hand) or based on all players' hands and actual residual cards available. Exactly three community cards preferably will be sequentially offered for replacement, so the larger number of cards needed to possibly comprise a winning result, the riskier the game. For example, if the player has been notified that at least three cards are needed for an eventual win, the player may choose to Fold, losing at least his Ante wager. On the other hand, if only one community card may possibly provide a win, the player may choose to continue play. After the initial array of seven cards is dealt, each player may decide to either Fold (losing at least the Ante wager), Take Win if his hand already has two qualifying melds, or Play. At any time the player Takes the Win, his game is over, and any wagers still in play will be paid according to a predetermined paytable. If the player decides to Play, the wager for the $1^{st}$ community card is forfeited or paid to the machine, and the community card is dealt. The player may now choose to either keep the $1^{st}$ community card, touching one of the originally dealt cards in either meld for replacement with the $1^{st}$ community card, or pass on the card. In either case, the decision is then locked in, and the Optimum Expected Value function is again applied to the cards in the melds to rearrange the cards, if necessary, to provide the optimum configuration for a potential win. After the $1^{st}$ community card play is finalized, each player may again decide to either Fold (losing at least the Ante bet), Take Win if his hand already has two qualifying melds, or Play. If the player decides to Play, the wager for the $2^{nd}$ community is forfeited or paid to the machine, and the $2^{nd}$ community card is dealt. The player may now choose to either keep the $2^{nd}$ community card, touching one of the cards in either meld for replacement with the $2^{nd}$ community card, or pass on the card. In either case, the decision is locked in, and the Optimum Expected Value function is again applied to the cards in the melds to rearrange the cards, if necessary, to provide the optimum configuration for a potential win. After the $2^{nd}$ community card play is finalized, each player may again decide to either Fold (losing at least the Ante wager), Take Win if his hand already has two qualifying melds, or Play. If the player decides to Play, the wager for the $3^{rd}$ and final community is forfeited or then paid to the machine, and the $3^{rd}$ community card is dealt. The player may now choose to either keep the final community card, touching one of the cards in either meld for replacement with the final community card, or pass on the card. In either case, the decision is locked in, and the Optimum Expected Value function is again applied to the cards in the melds. The final array of cards in the two meld areas are now analyzed for qualification. Both melds must have qualifying arrays of predetermined arrangements of cards such as runs, matches, straights, flushes, a straight flush, a royal flush, or like-ranked cards (as 3-, 4- or 5-of-a-kind) in order to win the game. Wins are paid according to a predetermined paytable that is based on the particular 3-card meld result paired with the particular 4-card meld result. For example, if the 3-card meld is a straight and the 4-card meld is 4-of-a-Kind, the payoff will be Straight/4-of-a-Kind as determined by the predetermined paytable. There preferably are no payouts for individual melds, even the highest ranking melds, but optionally there may be modest payouts for highest ranks, such as four-card straight flushes, four-of-a-kind, three-card straight flushes and three-of-a-kind in the three-card hand. This is less preferred because there are so many cards (e.g., seven cards) are available from which these hands may be constructed.

In a second preferred embodiment of the present invention, the attributes of the aforementioned gameplay are the same, with the initial deal being 10 different cards and the meld areas being provided for two 3-card melds and one 4-card meld.

Reference to the Figures will assist in further understanding of the practice of the present invention.

FIG. 1 shows a single player monitor screen layout 2 with elements for a 7-card rummy game to be played on an electronic device. The initial seven cards in the game will be dealt into two areas: the 3-card meld 4 consisting of three individual card areas (6, 8, 10), and the 4-card meld 12 consisting of four individual card areas (14, 16, 18, 20). A community card area 30 is shown at the top of the screen. Also shown are five betting circle areas consisting of an Ante 40, a 1st Card 42, a 2nd Card 44, a 3rd Card 46, and Play 48. Five player buttons (physical or virtual) are shown, including Fold 50, Play 52, Lock 54, Optimize 56, and Take Win 58.

Figure 2:
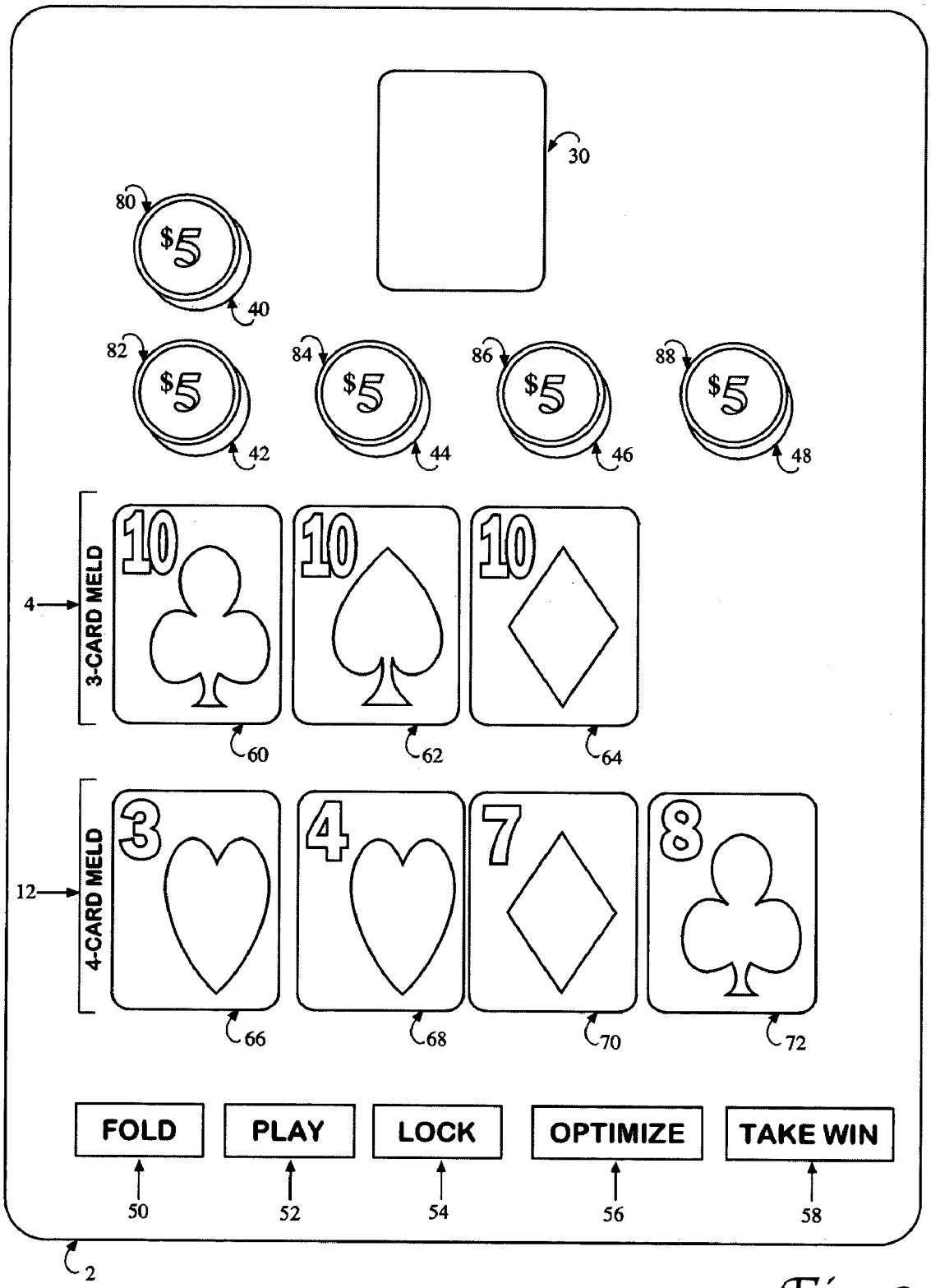
FIG. 2 shows a first game utilizing the game technology described herein.

FIG. 2 refers to the elements in FIG. 1 and shows the wagering and initial deal for a first game. Here the player has made the required five equal bets to play the game (80, 82, 84, 86, 88), as illustrated by one $5 chip being placed on each of the five betting circles. Seven different cards from one virtual single traditional deck of 52 cards are randomly dealt to each player who has wagered to play the game. The single-player monitor screen shows the seven dealt cards being shown face up, and having been placed in either the 3-card meld area or the 4-card meld area according to an Optimum Expected Value function. The 3-card meld area is now comprised of the 10 of Clubs 60, the 10 of Spades 62, and the 10 of Diamonds 64. The 4-card meld area is now comprised of the 3 of Hearts 66, the 4 of Hearts 68, the 7 of Diamonds 70, and the 8 of Clubs 72.

Figure 3:
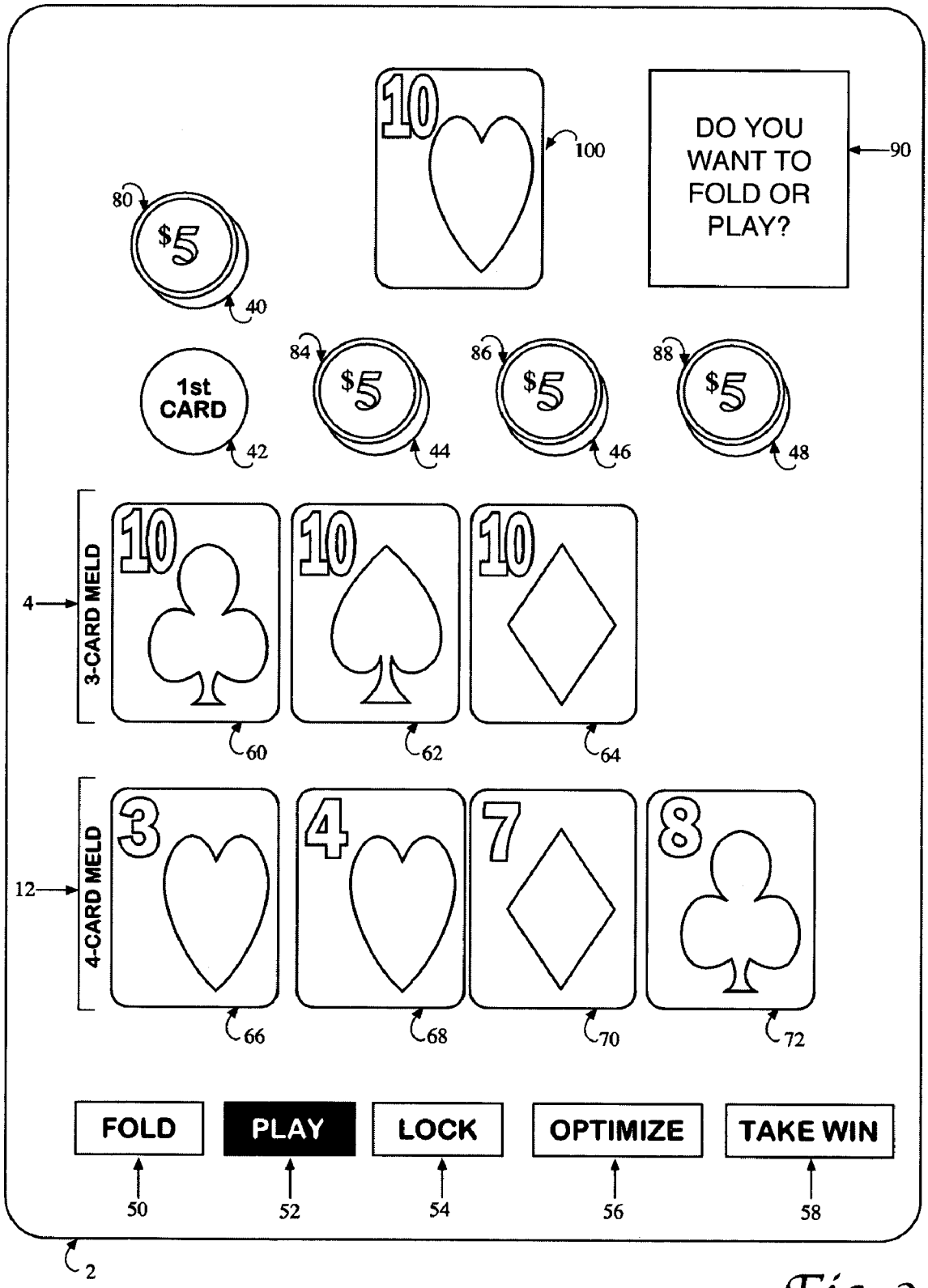
FIG. 3 shows the first game at a later stage.

FIG. 3 refers to the elements in FIG. 2, and shows the beginning of the community card play. After each wagered player has received his initial seven dealt cards, he may choose to either Fold or Play, as shown in a message box 90. Here the player decides to continue with the game instead of Folding. Since his cards look lucrative, with a good potential for an eventual win, the player presses the Play button 52. Immediately, the $5 wager for a 1st community card is eliminated from the screen and paid to the house, and the 1st community card, the 10 of Hearts 100 is dealt to all players who have decided to continue playing.

Figure 4:
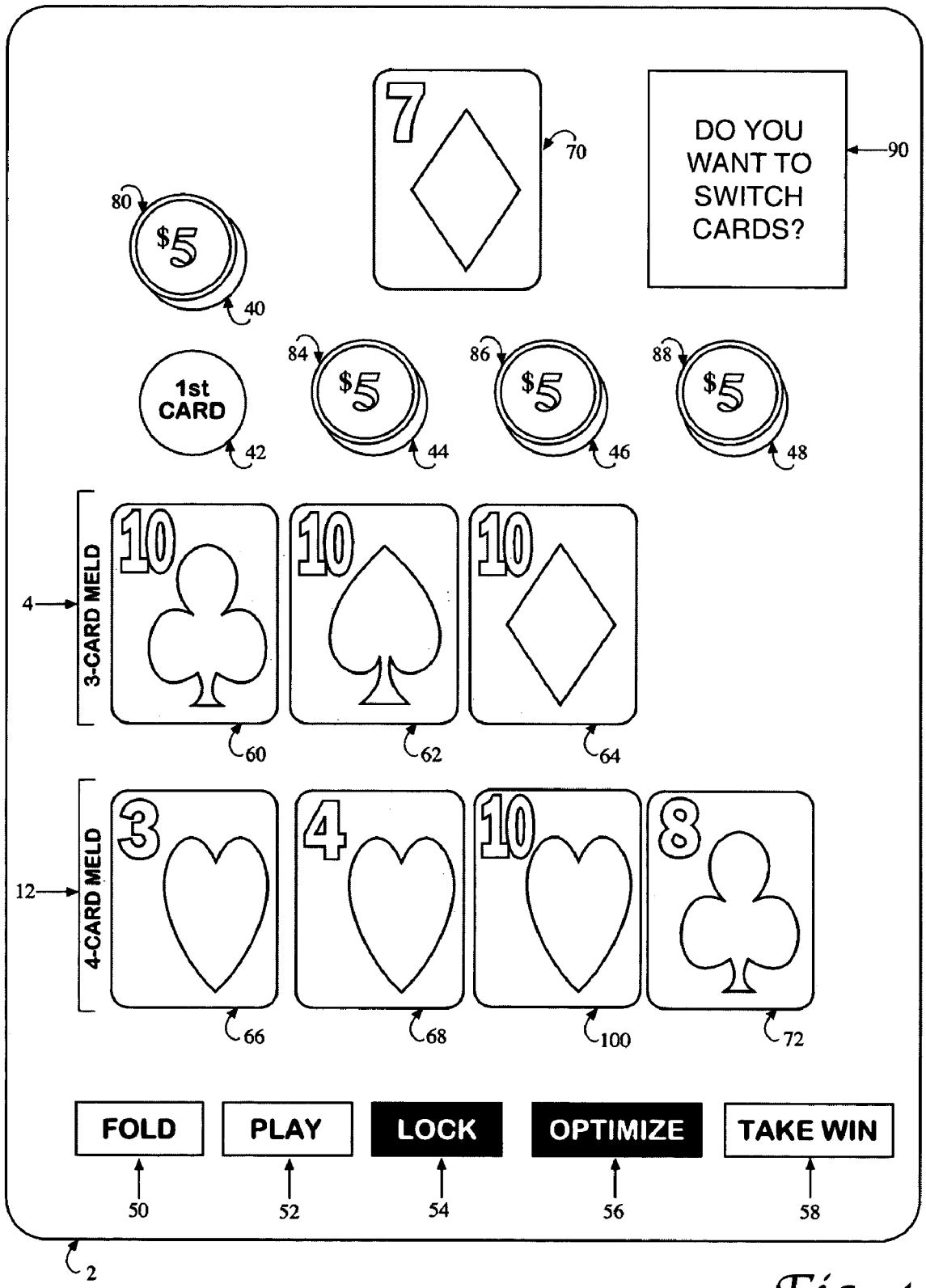
FIG. 4 shows the first game at a later stage.

FIG. 4 refers to the elements in FIG. 3, as each player is asked via the message box 90 whether or not he would like to switch the 1st community card with one of his initially-dealt cards. Here the player has touched the third card in the 4-card meld, the 7 of Diamonds 70. Immediately the 10 of Hearts 100 is switched with the 7 of Diamonds 70. He locks in the choice by pressing Lock 54, and then Optimize 56. (Had the player decided NOT to keep the 1st community card, he would NOT have touched an initially-dealt card, and would have only pressed Lock 54).

Figure 5:
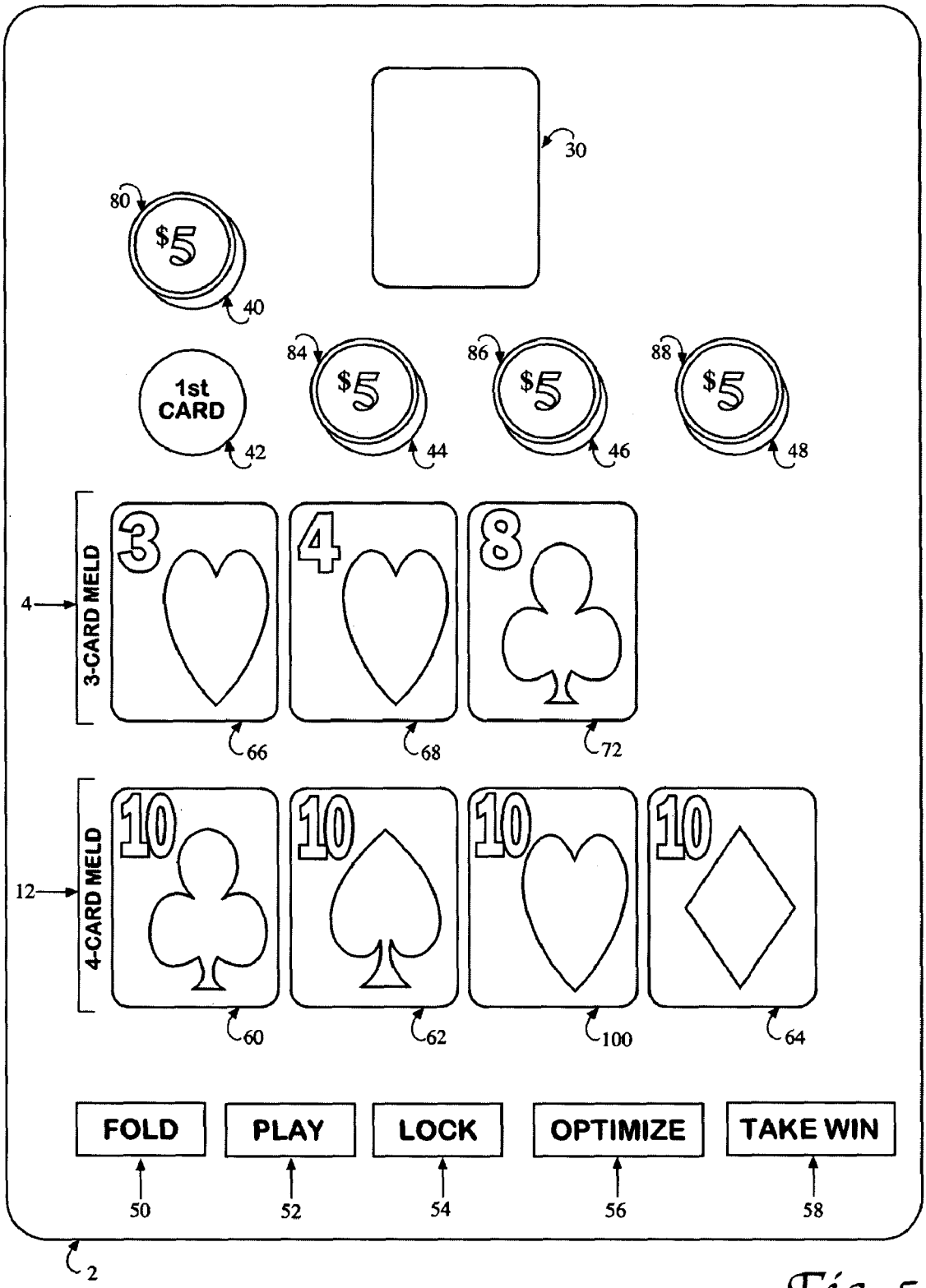
FIG. 5 shows the first game at a later stage.

FIG. 5 refers to the elements in FIG. 4 after the player has locked in his choice and pressed Optimized. The altered array of seven cards is rearranged by the Optimum Expected Value function, and now the 3-card meld is comprised of the 3 of Hearts 66, the 4 of Hearts 66, and the 8 of Clubs 72. The 4-card meld is now comprised of the four 10s (60, 62, 100, 64) and ranks as 4-of-a-Kind.

Figure 6:
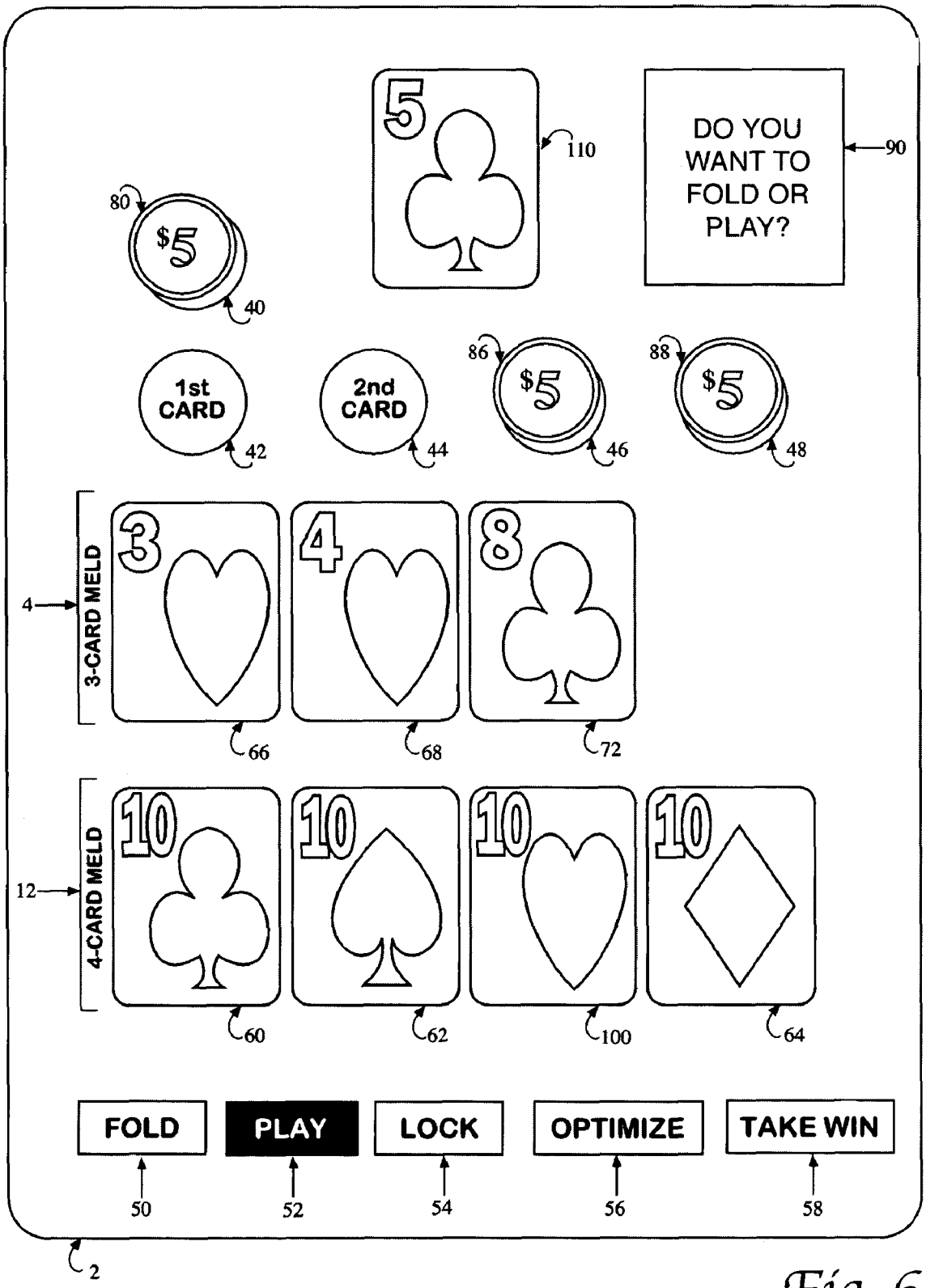
FIG. 6 shows the first game at a later stage.

FIG. 6 refers to the elements in FIG. 5; after being prompted in the message box 90 to either Fold or continue playing, the player decides to continue on by pressing the Play button 52. Immediately, the $5 wager for a 2nd community card is eliminated from the screen and paid to the house, and the 2nd community card, the 5 of Clubs 110 is dealt to all players who have decided to continue playing.

Figure 7:
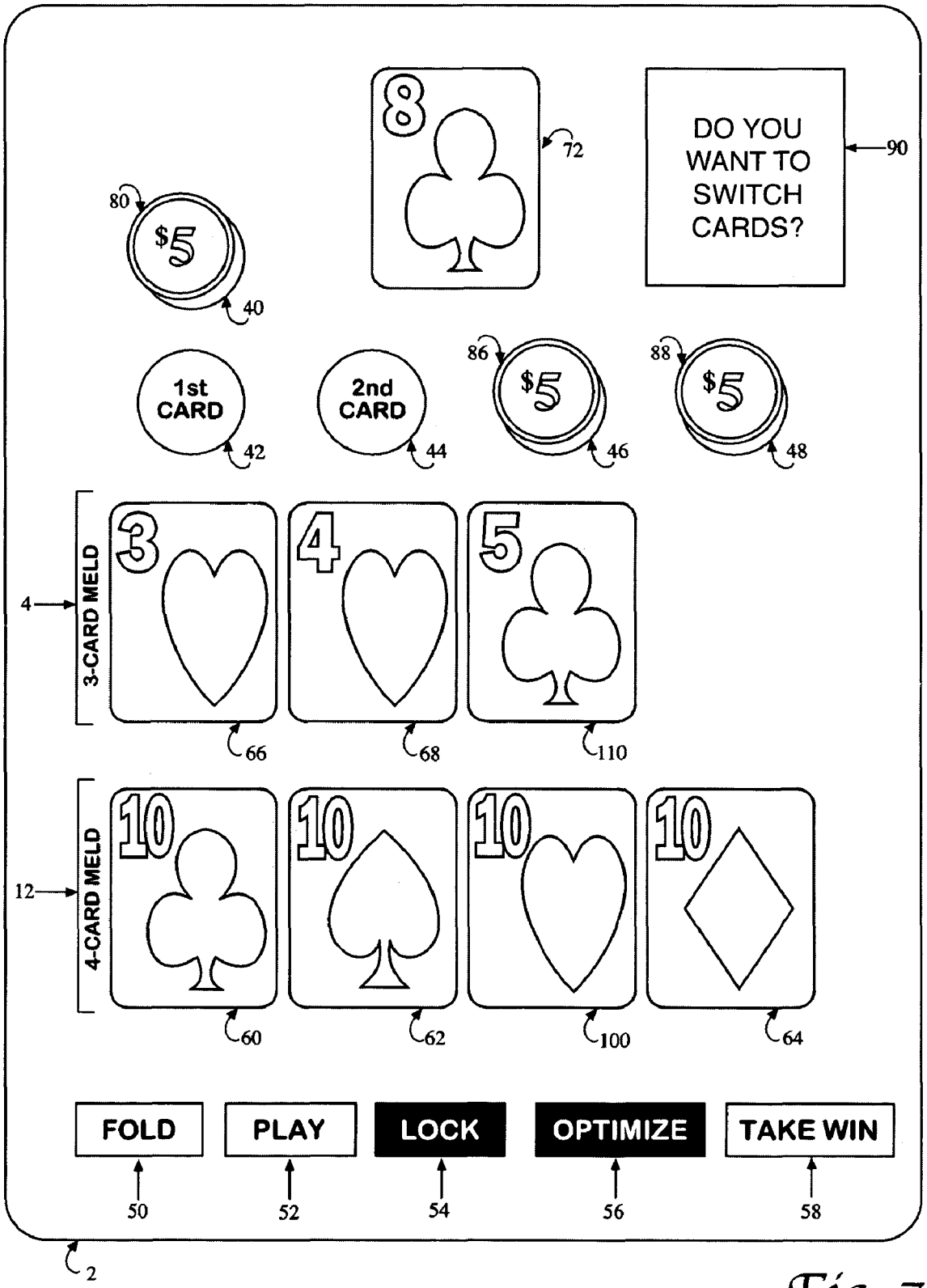
FIG. 7 shows the first game at a later stage.

FIG. 7 refers to the elements in FIG. 6, as each player is asked via the message box 90 whether or not he would like to switch the 2nd community card with one of his meld cards. Here the player has touched the third card in the 3-card meld, the 8 of Clubs 72. Immediately the 5 of Clubs 110 is switched with the 8 of Clubs 72. He locks in the choice by pressing Lock 54, and then Optimize 56.

Figure 8:
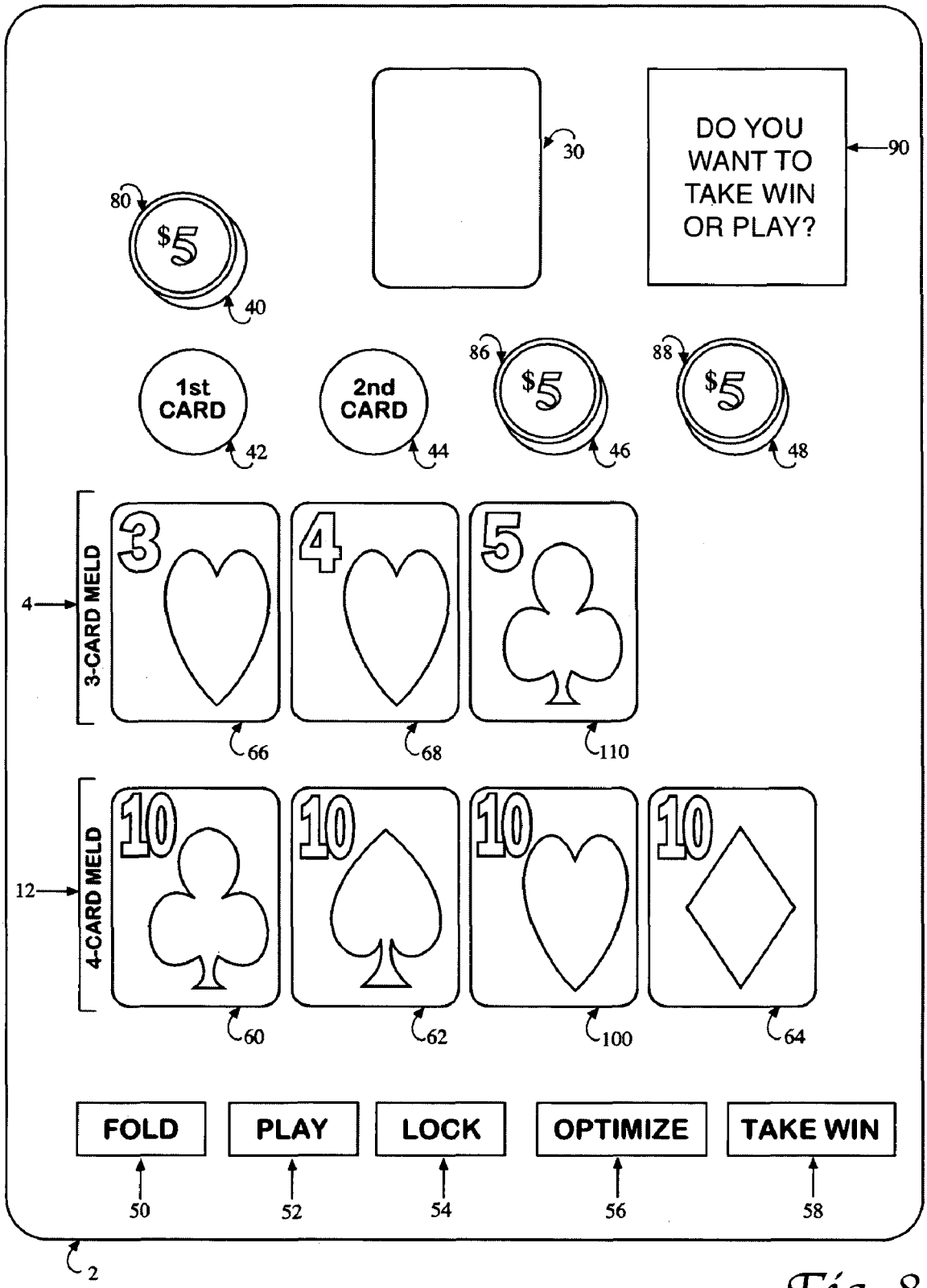
FIG. 8 shows the first game at a later stage.

FIG. 8 refers to the elements in FIG. 7 after the player has locked in his choice and pressed Optimized. The altered array of seven cards is rearranged by the Optimum Expected Value function (in this case the cards are already in optimal positions and remain in place), and now the 3-card meld is comprised of the 3 of Hearts 66, the 4 of Hearts 66, and the 5 of Clubs, and ranks as a Straight. The 4-card meld is still comprised of the four 10s (60, 62, 100, 64) and ranks as 4-of-a-Kind. The message box 90 alerts the player that he has achieved a winning game (a 3-card Straight with 4-of-a-Kind), and may now decide to Take the Win or play on. If he Takes the Win now, he would be paid Straight/4-of-a-Kind odds on the three remaining wagers, and the game would be over. If he plays on, he may or may not achieve a more lucrative win, but in either case will not be paid on the 3rd community card wager.

Figure 9:
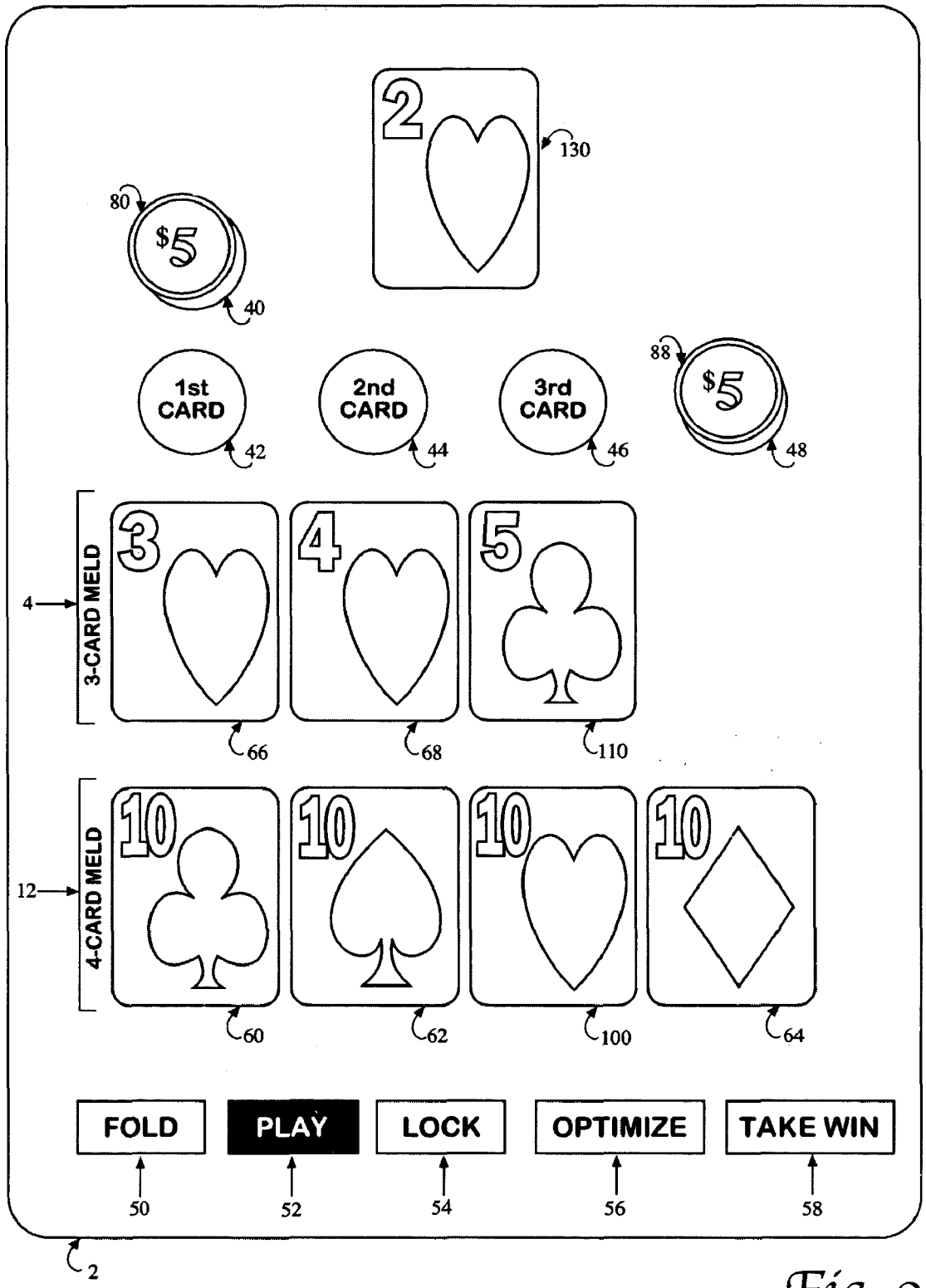
FIG. 9 shows the first game at a later stage.

FIG. 9 refers to the elements in FIG. 8 with the player deciding to play on. He presses Play 52. Immediately, the $5 wager for a 3rd community card is eliminated from the screen and paid to the house, and the 3rd community card, the 2 of Hearts 130 is dealt to all players who have decided to continue playing.

Figure 10:
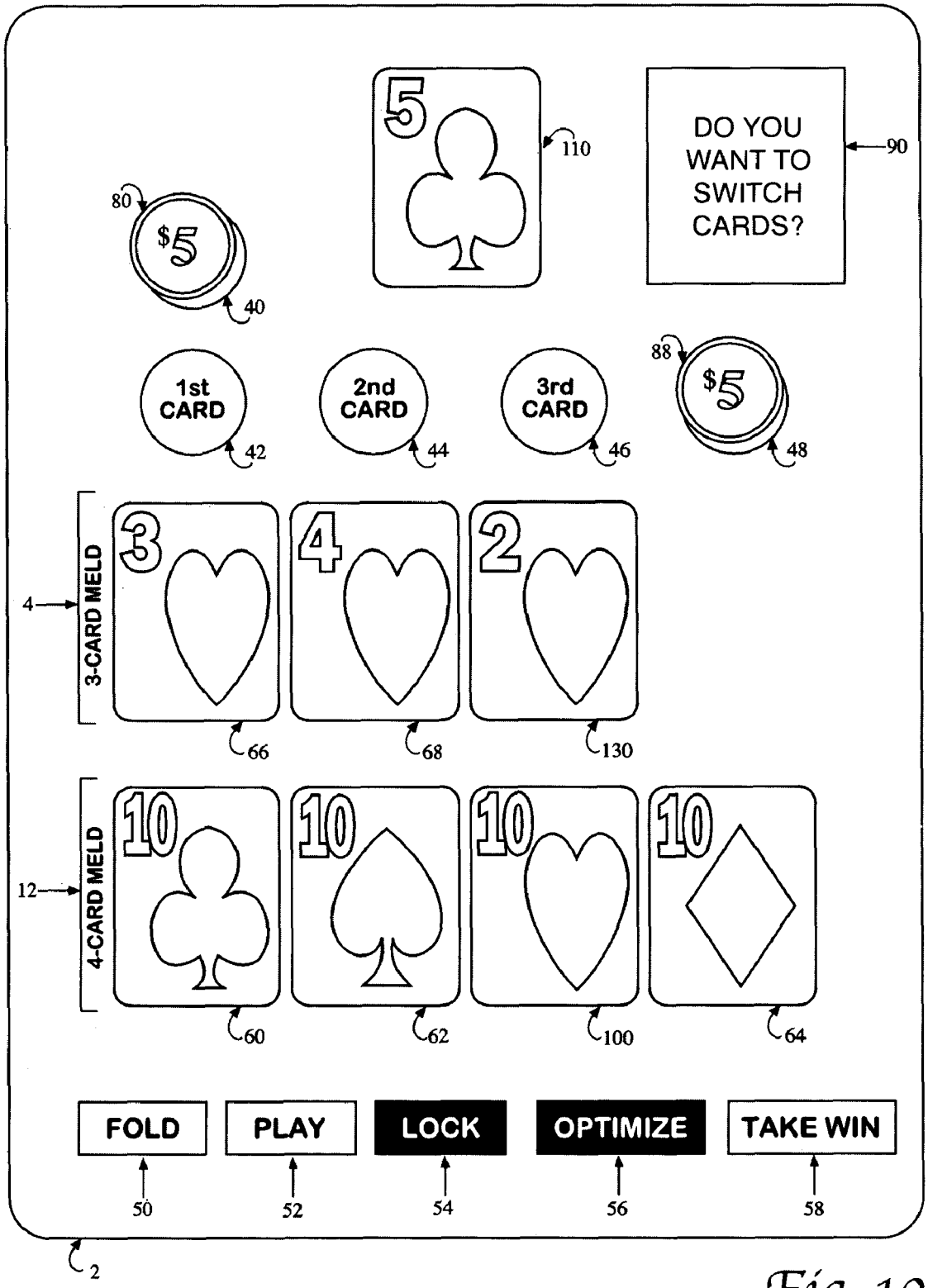
FIG. 10 shows the first game at a later stage.

FIG. 10 refers to the elements in FIG. 9, as each player is asked via the message box 90 whether or not he would like to switch the 3rd community card with one of his meld cards. Here the player has touched the third card in the 3-card meld, the 5 of Clubs 110. Immediately the 2 of Hearts 130 is switched with the 5 of Clubs 110. He locks in the choice by pressing Lock 54, and then Optimize 56.

Figure 11:
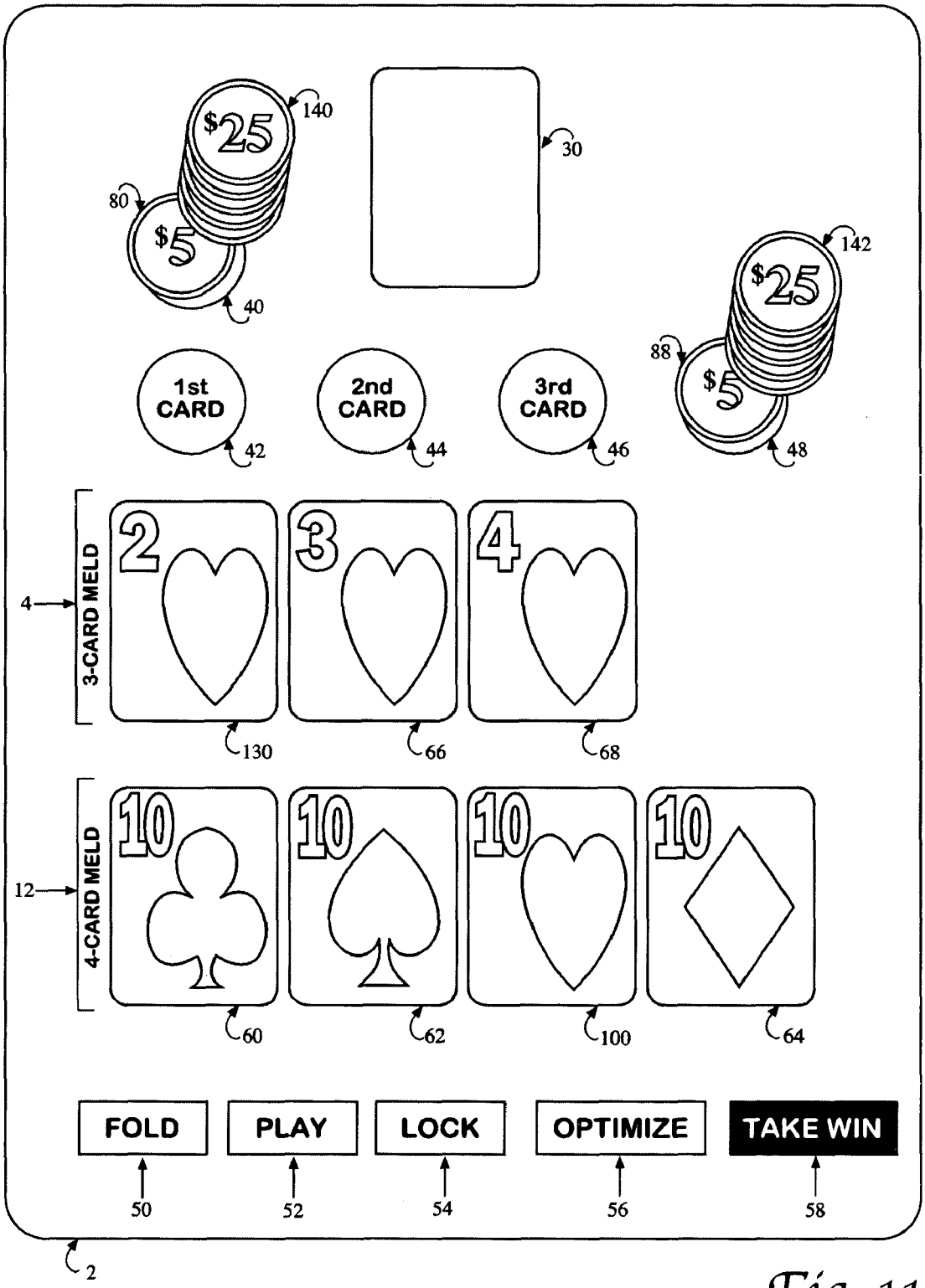
FIG. 11 shows the first game at a final stage.

FIG. 11 refers to the elements in FIG. 10 with the player achieving a final game result of Straight Flush/4-of-a-Kind. The "Take Win" button 58 is highlighted, and he is paid odds 140 on the Ante wager and odds 142 on the Play wager.

Figure 12:
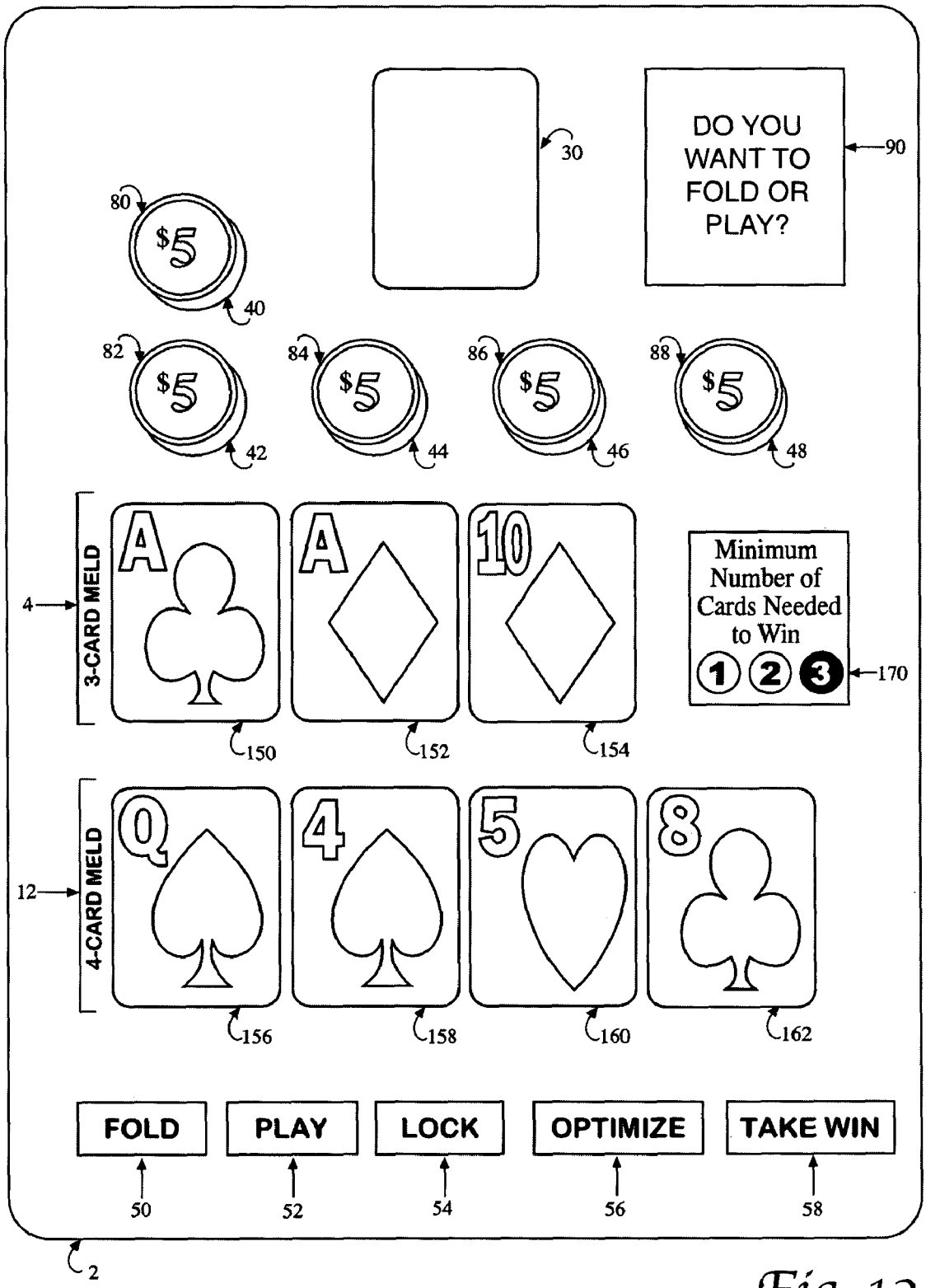
FIG. 12 shows a second game utilizing the game technology described herein.

FIG. 12 refers to the elements in FIG. 1 and shows the wagering and initial deal for a second game. Here the player has made the required five equal bets to play the game (80, 82, 84, 86, 88), as illustrated by one $5 chip being placed on each of the five betting circles. Seven different cards from one virtual single traditional deck of 52 cards are randomly dealt to each player who has wagered to play the game. The single-player monitor screen shows the seven dealt cards being shown face up, and having been placed in either the 3-card meld area or the 4-card meld area according to an Optimum Expected Value function. The 3-card meld area is now comprised of the Ace of Hearts 150, the Ace of Diamond 152, and the 10 of Diamonds 154. The 4-card meld area is now comprised of the Queen of Spades 156, the 4 of Spades 158, the 5 of Hearts 160, and the 8 of Clubs 162. In this gameplay example, an additional feature is illustrated. After deal of the initial or community cards, an information window 170 indicates the minimum number of cards that would be needed to make a winning game. Here the player is shown that the initial deal is not strong, and it would take all three community cards to possibly have the game end in a win. The message box 90 asks the player to Fold or Play.

Figure 13:
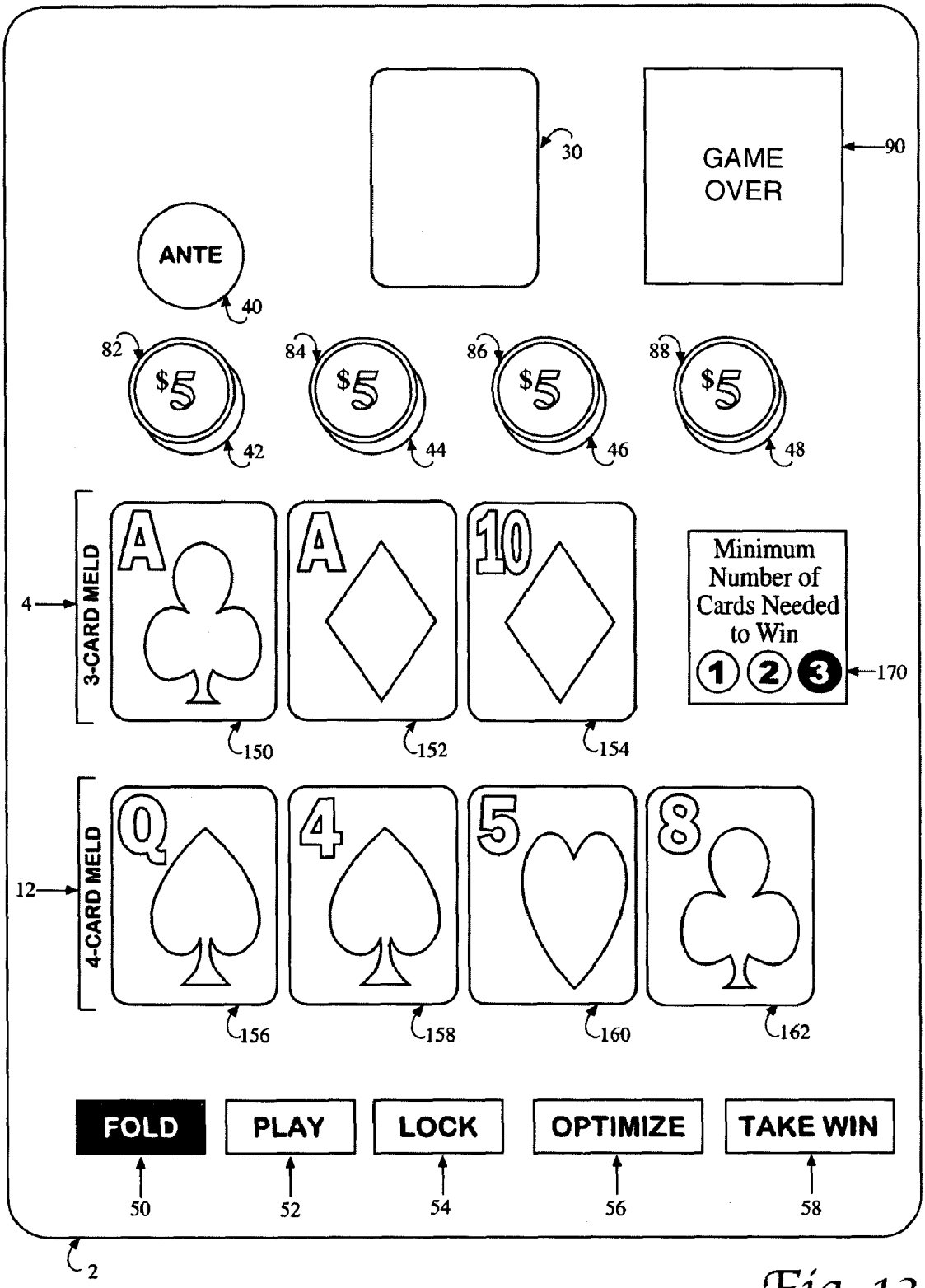
FIG. 13 shows the second game at a final stage.

FIG. 13 refers to the elements in FIG. 12, and shows the player deciding to Fold instead of playing on. The Ante wager is forfeited (although in a separate embodiment, both the Ante wager and the Play wager are forfeited), and the game is over.

The various components of the electronic table or gaming machine are controlled by a central processing unit (CPU), also referred to herein as a controller or processor (such as a microcontroller or microprocessor). To provide gaming functions, the controller executes one or more game programs stored in a computer readable storage medium, in the form of memory. The controller performs the random selection using a random number generator (RNG) of an outcome from the plurality of possible outcomes of the wagering game. Alternatively, the random event may be determined at a remote controller. The remote controller may either use an RNG or a pooling scheme for its central determination of a game outcome. It should be noted that the controller may include one or more microprocessors, including, but not limited to, a master processor, a slave processor, and a secondary or parallel processor.

The controller is also coupled to the system memory and a money/credit detector. The system memory may comprise a volatile memory (e.g., a random-access memory [RAM]) and a non-volatile memory (e.g., an EEPROM). The system memory may include multiple RAM and multiple program memories. The money/credit detector signals the processor that money and/or credits were input via the value input device. Preferably, these components are located within the housing of the gaming machine. However, as explained above, these components may be located outboard of the housing and connected to the remainder of the components of the gaming machine via a variety of different wired or wireless connection methods.

The controller is also connected to, and controls, the primary display, the player input device, and a payoff mechanism. The payoff mechanism is operable, in response to instructions from the controller, and awards a payoff to the player in response to certain winning outcomes that might occur in the basic game or the bonus game(s). The payoff may be provided in the form of points, bills, tickets, coupons, cards, etc. For example, the payoff mechanism may include both a ticket printer and a coin outlet. However, any of a variety of payoff mechanisms well known in the art may be implemented, including cards, coins, tickets, smartcards, cash, etc. One or more pay tables stored in the system memory determine the payoff amounts distributed by the payoff mechanism.

Communications between the controller and both the peripheral components of the gaming machine and external systems occur through input/output (I/O) circuits. More specifically, the controller directs and receives inputs from the peripheral components of the gaming machine through the input/output circuits. Further, the controller communicates with the external systems via the I/O circuits and a communication path (e.g., serial, parallel, IR, RC, 10bT, etc.). The external systems may include a gaming network, other gaming machines, a gaming server, communications hardware, or a variety of other interfaced systems or components. Even though the I/O circuits may be shown as a single block, it should be noted that each of the I/O circuits may include different types of I/O circuits.

Controller, as used herein, comprises any combination of hardware, software, and/or firmware that may be disposed or reside inside and/or outside the gaming machine that may communicate with and/or control the transfer of data between the gaming machine and a bus, another computer, processor, or device and/or a service and/or a network. The controller may comprise one or more controllers or processors. The controller may, alternatively, comprise a CPU in combination with other components, such as the I/O circuits and the system memory.

Although specific examples and specific paytables have been provided in this discussion, these specifics are intended to be only support for the generic concepts of the invention and are not intended to be absolute limits in the scope of the technology discussed.

What is claimed:

1. A method of playing an electronic wagering card game in which card rank and card suit information is provided to a processor, the method comprising:

a) at least one player placing at least an Ante wager at risk;

b) the at least one player receiving a multiple number of playing cards comprising at least 5 original playing cards;

c) distributing the at least five original playing cards between at least two separate play areas;

d) the processor identifying an optimum strategy or probability of success for one or more strategies which are displayed to the at least one player;

e) the player making an election to either i) fold and lose the at least one wager;

ii) accept a winning outcome on the at least five original playing cards; or iii) wager or pay for at least one community playing card that optionally may be used to replace individual ones of the at least five original playing cards; and f) resolving any wagers remaining in play based upon at least predetermined combinations of cards in both of the at least two separate play areas.

2. The method of claim 1 wherein before step f), a player may make at least one election to wager or pay for at least one second community playing card that optionally may be used to replace remaining individual ones of the at least five original playing cards or a previous replacement playing card accepted by the at least one player.

3. The method of claim 1 wherein the processor automatically distributes the at least five original playing cards between at least two separate play areas according to processor determined best strategy.

4. The method of claim 2 wherein the processor automatically distributes the at least five original playing cards and any previous replacement playing cards accepted by the at least one player between at least two separate play areas according to processor determined best strategy.

5. The method of claim 3 wherein all playing cards are virtual playing cards displayed on display screens.

6. The method of claim 4 wherein all playing cards are virtual playing cards displayed on display screens.

7. The method of claim 2 wherein before step f), a player may make at least two elections to wager or pay for at least two second community playing card that optionally may be used to replace remaining individual ones of the at least five original playing cards or a previous replacement playing card accepted by the at least one player.

8. The method of claim 7 wherein the processor automatically distributes the at least five original playing cards and any previous replacement playing cards accepted by the at least one player between at least two separate play areas according to processor determined best strategy.

9. The method of claim 8 wherein all playing cards are virtual playing cards displayed on display screens.

10. The method of claim 1 wherein an objective in each of the at least two separate play areas is to form melds of playing cards.

11. The method of claim 2 wherein an objective in each of the at least two separate play areas is to form melds of playing cards.

12. The method of claim 4 wherein an objective in each of the at least two separate play areas is to form melds of playing cards.

13. The method of claim 5 wherein an objective in each of the at least two separate play areas is to form melds of playing cards.

14. The method of claim 7 wherein an objective in each of the at least two separate play areas is to form melds of playing cards.

15. The method of claim 8 wherein an objective in each of the at least two separate play areas is to form melds of playing cards.

16. The method of claim 9 wherein an objective in each of the at least two separate play areas is to form melds of playing cards.

17. The method of claim 1 wherein a separate wager may be placed on bonus events, which wager is always at risk during the play of the game and cannot be withdrawn.

18. A multiplayer platform system comprising: a) a processor, b) multiple player input positions and displays that show each player separate player hands of playing cards, c) at least one display showing community cards; wherein the processor has a game engine that controls play of a card game according to the method of claim 1.

* * * * *